United States Patent [19]

Howard

[11] 4,306,126

[45] Dec. 15, 1981

[54] BATTERY CABLE SWITCH

[76] Inventor: Durrell U. Howard, 306 Krameria Dr., San Antonio, Tex. 78213

[21] Appl. No.: 66,971

[22] Filed: Aug. 16, 1979

[51] Int. Cl.[3] ..... H01H 9/04

[52] U.S. Cl. ..... 200/52 R; 200/302; 307/10 BP

[58] Field of Search ..... 200/52 R, 302, 284; 307/10 AT, 10 BP

[56] References Cited

U.S. PATENT DOCUMENTS

| | | | |
|---|---|---|---|
| 2,538,581 | 1/1951 | Minch et al. | 307/10 BP |
| 2,539,628 | 1/1951 | Kingdon | 200/284 |
| 2,659,042 | 11/1953 | Anderson et al. | 320/2 |
| 2,853,627 | 9/1958 | Karl | 307/10 BP |
| 3,760,134 | 9/1973 | McCray | 200/52 R |
| 3,888,560 | 6/1975 | Smith et al. | 200/284 |
| 4,107,490 | 8/1978 | Keane | 200/52 R |

*Primary Examiner*—J. V. Truhe
*Assistant Examiner*—Morris Ginsburg
*Attorney, Agent, or Firm*—Pollock, Vande Sande & Priddy

[57] ABSTRACT

The battery cable switch disclosed has electrically conductive bodies positioned in an insulating housing which also contains a reciprocating contactor movable into and out of contact with said bodies. The switch is remotely operable by an actuator having a cam slide for reciprocating the contactor and a detent for holding the contactor in its open position. Each conductive body can be detachably connected to a battery cable and the housing made watertight by seals around the cables and the actuator. Snap-on means are provided for connecting the actuator to the housing and the housing to its mounting bracket. Both the cam slide and the contactor may be spring biased and the motive portion of the actuator may take various forms.

18 Claims, 6 Drawing Figures

FIG 1
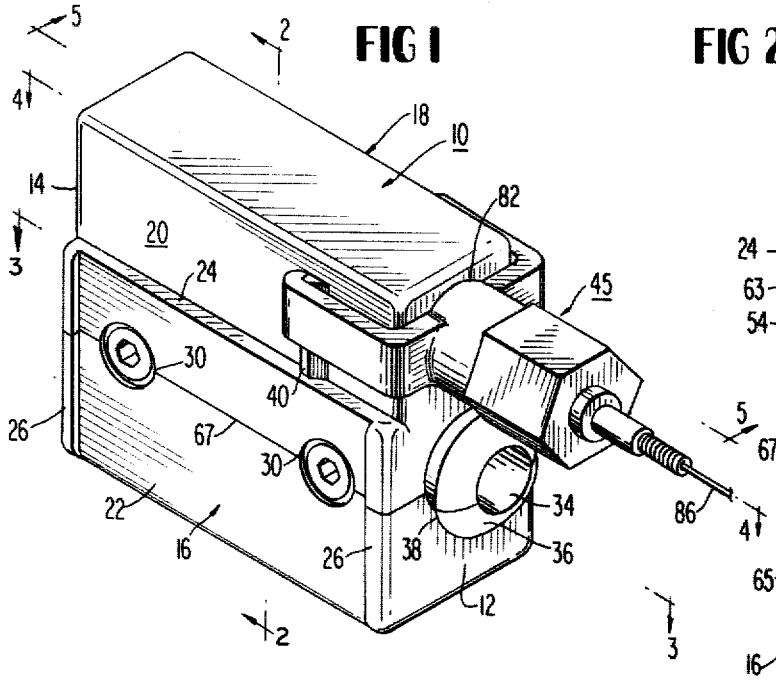
FIG 2
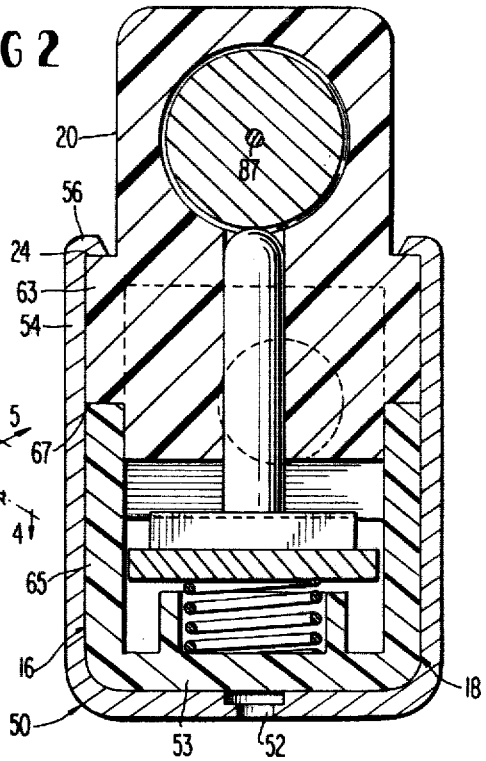
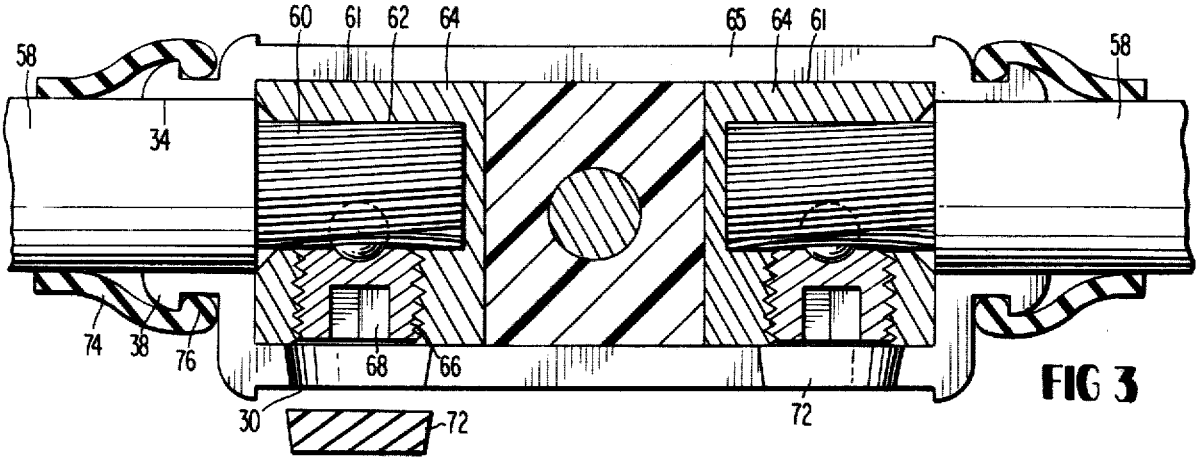
FIG 3
FIG 4
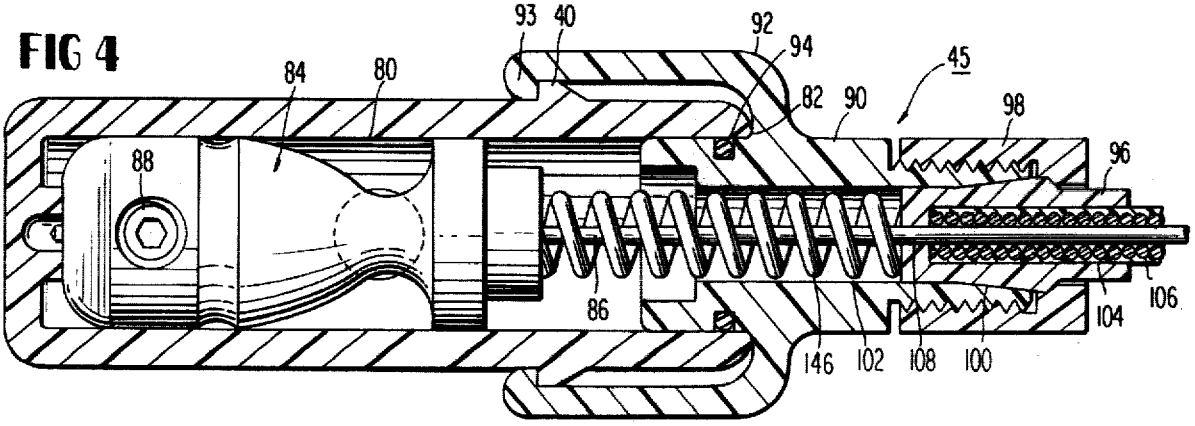

BATTERY CABLE SWITCH

FIELD OF INVENTION

This invention relates to electrical switches, and more particularly to switches for interrupting the electrical connection between heavy cables for carrying relatively high current loads. The invention is especially useful as a disconnect switch for vehicle battery cables.

BACKGROUND ART

There are a number of switch devices in the prior art adapted to be interposed between the storage battery and the electrical system of an automobile. The purpose of these devices is to provide a means for interrupting or breaking the electrical circuit so as to isolate the battery. This promotes safety and helps avoid fires by preventing accidental starting and eliminating short-circuits. Also, the components of the electrical system can be worked on without fear of causing a short-circuit that could damage component parts due to the high current loads available from the battery. Such devices also find utility in preventing depletion of the battery from small leaks to ground in the electrical system, as are often present in older vehicles of the classic or antique type, and as theft prevention devices.

The prior art includes breaker type switches wherein a removable breaker element is manually inserted and removed from between two contact members to make and break the electrical circuit, respectively. Two such devices are shown in the patents to Dunn et al., U.S. Pat. No. 2,801,399, and to Salters, U.S. Pat. No. 4,092,506. These breaker type switches are operable only at the switch juncture.

At least one remotely operated battery switch is also disclosed in the prior art as shown by the French patent to Palau, No. 814,033. However, Palau has only one electrical contact whereas double contacts are preferred in order to insure positive interruption of the electrical circuit when the switch is open, especially where foreign materials can build up between contact surfaces. The contact element of this device is also subject to frequent flexure which causes stress fatigue and can result in rapid failure.

Such prior art devices have a number of other significant disadvantages. Contact surfaces and other internal parts are exposed to moisture and other corrosive materials. The Palau and Dunn et al. switches are both mounted directly upon the battery terminal which subjects them to the corrosive action of battery fluids and terminal deposits.

DISCLOSURE OF THE INVENTION

The electrical switch of the present invention has a number of advantages over heavy cable switches of the prior art. The switch is designed especially for simple and efficient installation at a location intermediate to the ends of an existing battery cable rather than for attachment directly to a battery terminal. The switch preferably comprises a plastic housing into which two conductive bodies have been permanently positioned in longitudinally spaced relation. The bodies can be either pressed into a corresponding cavity within the housing or molded in position. In the usual application, a conventional battery cable is cut at the point of switch insertion and each cut end conductively secured to a corresponding conductive body. A reciprocating contactor element within the housing makes and breaks an electrically conductive path between the two conductive bodies. In its closed position, the contactor is biased against both conductive bodies to close the conductive path. In its open position, the contactor is lifted and held off of both conductive bodies to open the conductive path. Movement of the contactor is produced by a camming means having a camming action opposing contactor bias. The camming means includes an internal detent for frictionally locking the contactor in its open position and an externally operable actuator capable of actuating the camming action either at the switch itself or from a remote location. Where remote actuation is utilized, the camming means preferably includes a return spring to help overcome cable friction and the locking action of the detent and return the camming means to its contactor closing position.

Each conductive body in the switch housing has a relatively large contact area which is engaged by the contactor when the latter is in its closed position. This feature prevents significant current resistance, even if contact surfaces become worn or fouled by oxides or other foreign materials. Since the switch is mounted away from the battery terminals and sealed as discussed below, its connections and components are less likely to become fouled with corrosive-type contaminants. In its open position, the contactor is spaced from both conductive bodies by a substantial distance, thereby creating two air gaps instead of only one to ensure an open electrical circuit. The stroke of the contactor is sufficient to allow the dual contacts to be broken even if foreign material were allowed to accumulate on contact surfaces. This ensures that the switch can be readily opened throughout its useful life.

The switch housing comprises a special watertight enclosure. All of the switch components, except a portion of the actuator, are preferably carried within that housing enclosure. Receptacles for each end of the battery cable are surrounded by a nipple which carries a rubber boot in sealing engagement both with the housing and the watertight sheath surrounding the conductive wire or wires of the battery cable. The housing penetration for the camming actuator is also surrounded by a transition structure that sealingly engages both the switch housing and the outer surface of the actuator housing or shaft. Ports for cable securing screws are sealed by elastomer plugs held in position by their tapered shape and a bracket which surrounds the lower portion of the housing. The resulting battery switch is very compact in size and of a unique watertight construction.

Although the switch and bracket can be supported by the battery cable alone, the bracket may be optionally mounted anywhere on a vehicle frame or other structure. A snap-in relationship between the bracket and the housing makes for easy installation and maintenance of the switch components. Both battery cable ends and the actuator are also readily detachable so that the switch may be disengaged from all mounted components for maintenance or replacement as desired.

BRIEF DESCRIPTION OF THE DRAWINGS

Other important objects and advantages of the invention will be apparent from the following description and the accompanying drawings in which:

FIG. 1 is a prospective view of the switch housing with a remote actuating cable attached.

FIG. 2 is an end elevational view of the invention in section taken along lines 2—2 of FIG. 1.

FIG. 3 is a plan view of the invention in section taken along lines 3—3 of FIG. 1.

FIG. 4 is a plan view of the invention in section taken along lines 4—4 of FIG. 1.

BEST MODE FOR CARRYING OUT THE INVENTION

Figure 5:
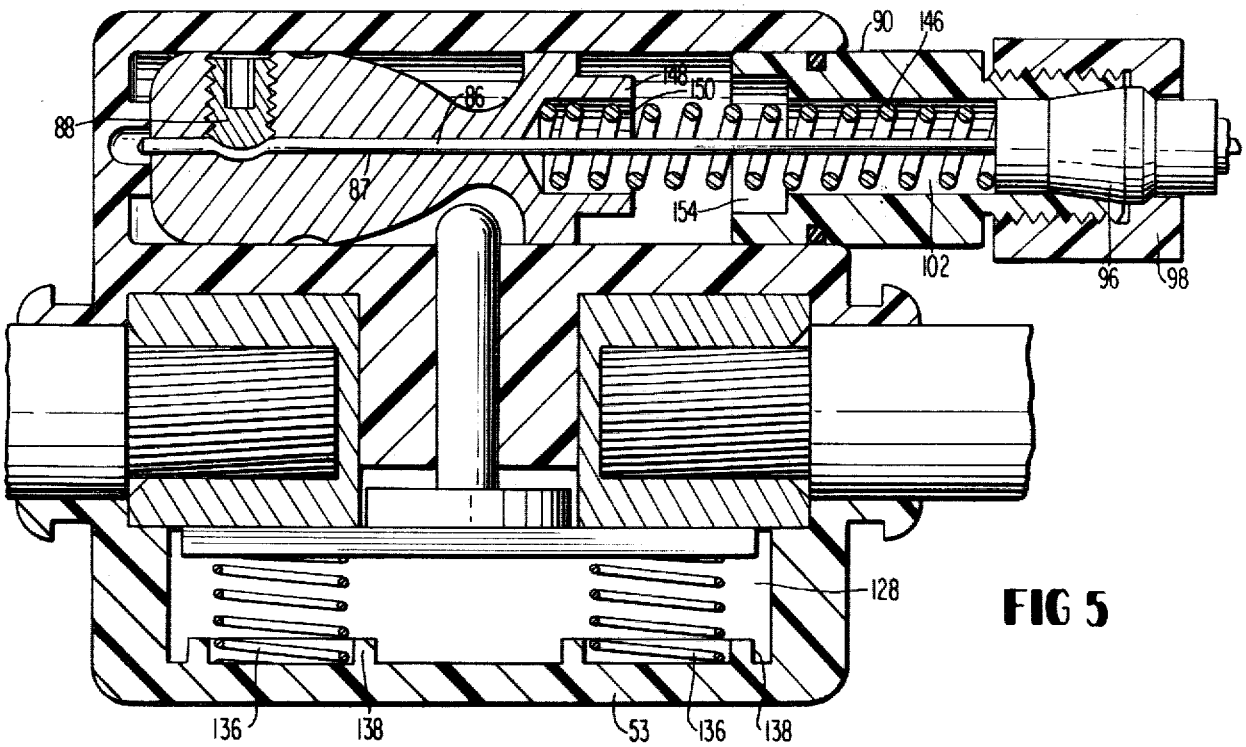
FIG. 5 is a side elevational view of the invention in section taken along lines 5—5 of FIG. 1 and illustrating the camming element in its first position for closing the switch.

A preferred embodiment of the invention is illustrated in FIGS. 1 to 5 of the drawings. As seen best in FIGS. 1 and 2, the switch includes a housing 10 having opposing end walls 12 and 14 and opposing sidewalls 16 and 18. The housing 10 is of electrically insulating material, preferably molded plastic. Each sidewall has an upper portion 20 recessed relative to a lower portion 22 to form a ledge 24. The lower portion 22 is bounded on each side by a pair of transverse ridges 26—26, one adjacent to each end wall. The lower portion of sidewall 16 has two access apertures 30—30, the function of which will be described below. Each end wall has a cable aperture 34 surrounded by a nipple 36 having an outwardly projecting annular lip 38. The upper portion 20 of each sidewall also includes a ridge 40 which extends substantially parallel to the end walls and cooperates with a switch actuator mechanism, generally designated 45, as also described below. The switch housing 10 is mounted upon any support structure desired, such as an automobile frame, by means of a mounting bracket 50, which may be secured to the support structure by passing two or more mounting screws through a set of counterbored holes 52 in the base of the bracket. The bracket is sized to fit snugly around the lower portion of the housing and a bottom housing wall 53. Bracket 50 is U-shaped with arms 54 that fit over sidewalls 22 between opposing ridges 26—26. A lip 56 extends longitudinally along the upper edge of each bracket arm so as to engage ledges 24—24 as shown in FIG. 2. The mounting bracket is preferably of a resilient spring-like material, such as spring metal or a comparable plastic, so that the lip 56 will snap over and firmly engage the ledges after being forced apart to receive the lower portion of the housing. When the bracket is snapped in place, ridges 26—26 prevent longitudinal movement of the housing.

With reference to FIGS. 2 and 3, one end of a battery cable segment 58 passes through one of the cable apertures 34 where a stripped portion 60 is received within a receptacle 62 in a conductive insert or body 64 adjacent to the aperture. The conductive bodies 64—64 are spaced longitudinally apart and are preferably pressed fitted into cavities 61—61 as an upper housing section 63 is pressed down against a lower housing section 65 until the two sections abut along opposing edges 67—67. The sections are then ultrasonically welded together along these edges which become indistinct as the plastic melts and the two sections meld together. As an alternative, the inserts can be molded in place and related components installed through a bottom cover which is then welded in place to form bottom wall 53.

The conductive inserts are preferably of copper and include a set screw 66 for securely clamping the stripped end of the battery cable within the insert. Set screw 66 has a socket 68 for receiving an Allen type wrench, although it is to be understood that other types of set screws may be used. Sidewall apertures 30 provide access to the set screws for tightening or loosening the same. The apertures are preferably tapered and filled by tapered watertight plugs 72 of elastomer material, such as rubber. These plugs seal the apertures and are locked in position when the housing is secured within the mounting bracket 50. To provide a watertight seal around the cable apertures, a rubber boot 74 sealingly engages the insulating covering or sheath of the cable and has an inner bead 76 which snaps over the lip 38 to sealingly engage the housing nipple 36.

As seen best in FIGS. 1 and 4, the upper portion of the switch housing includes a cylindrical chamber or bore 80 having an entrance opening 82 in end wall 12 through which it receives a portion of actuator 45. Actuator 45 includes a camming slide 84 arranged to reciprocate within chamber 80 and a push-pull actuator wire 86 secured within a longitudinal passage 87 in the slide by a set screw 88. The entire slide and actuator wire assembly is secured within the chamber 80 by means of a retainer having a barrel 90 and a pair of clamping arms 92—92 that lockingly engage upper sidewall ridges 40—40. This slide retainer assembly is preferably made of a resilient, spring-like plastic permitting the lip portion 93 of the arms to snap over the ridges.

Figure 6:
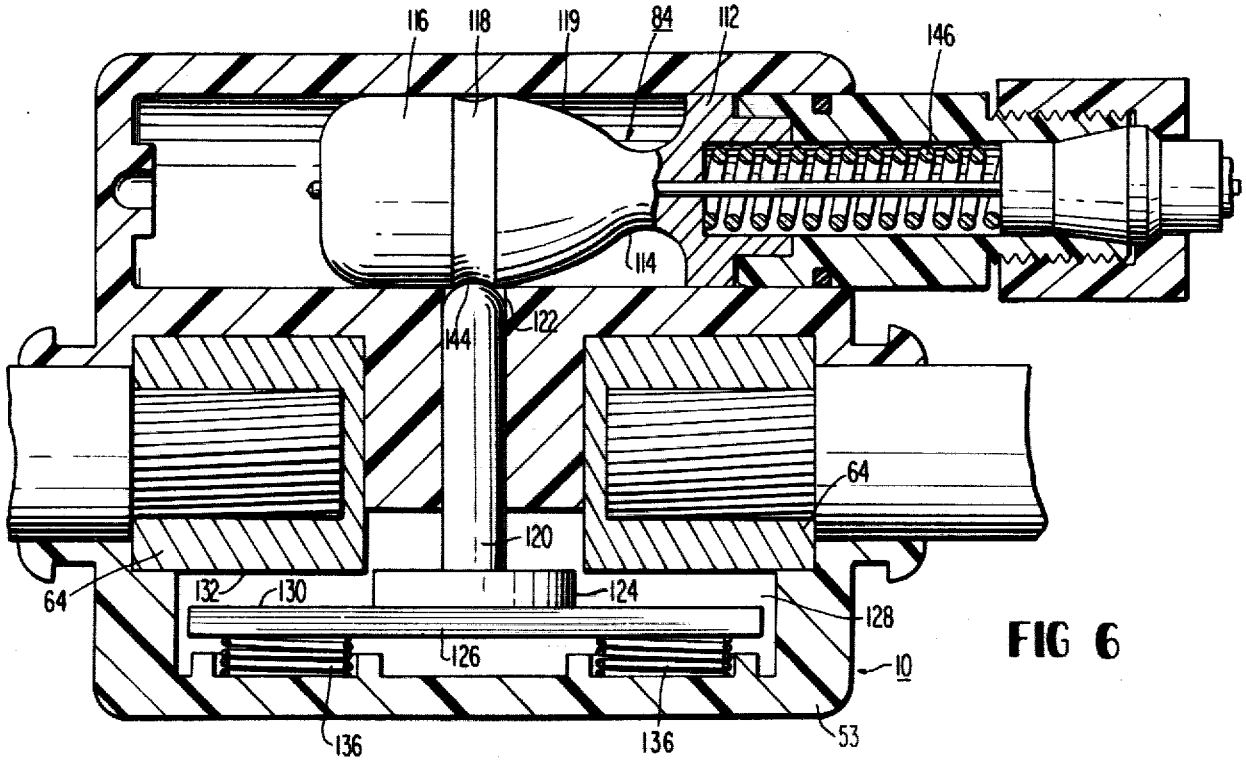
FIG. 6 is a sectional view of the invention similar to FIG. 5 illustrating the camming element in its second position for opening the switch.

The forward end of barrel 90 projects into housing chamber 80 and sealingly engages the chamber wall by means of an O-ring type seal 94. A resilient bushing 96 of rubber-like material forms a similar watertight seal at the rear end of barrel 90 where it is held in place by a nut 98 threaded on the barrel. For economy and ease of assembly, nut 98 may be of the cam lock type which slides axially onto the barrel and rotates to engage one or more thread-like cam segments. Bushing 96 has an inwardly tapered forward surface 100 which engages a corresponding surface on a cylindrical bore 102 extending through barrel 90. The bushing in turn has a bore 104 of sufficient diameter to receive an actuator housing 106. Bore 104 ends at a forward aperture 108 which preferably has a diameter slightly less than that of push-pull wire 86 so as to sealingly engage the wire. As seen in FIGS. 4 to 6, the nut 98 engages abutting surfaces on the bushing so that tightening of the nut forces the bushing forward into sealing engagement with both the actuator wire and its housing.

The camming means for opening and closing the switch in response to reciprocating movement of the actuator wire will now be described with reference to FIGS. 5 and 6. The slide 84 includes a base 112, a neck portion 114 and a head 116. The head has a detent groove 118 running around its periphery. The outer surface of the slide between the neck 114 and the groove 118 serves as a camming surface 119 for engaging a cam follower 120. Cam follower 120 is arranged for reciprocating movement in a bore 122 and has a pedestal 124 secured to a contactor plate 126. Contactor 126 is arranged for reciprocating movement in a chamber 128 within the lower portion of housing 10. The contactor is preferably in the form of a rectangular plate with two relatively large contact surfaces 130 at each end, one for uniformly abutting a corresponding contact surface 132 on each of the conductive inserts 64.

Although both abutting contact surfaces are preferably flat, they may be semi-circular or have some other cooperating shape providing substantially uniform abutment over the entire contact area of surfaces 130. It is also to be understood that additional cable terminals can be provided by including additional inserts in the housing body and providing additional arms on the contactor plate for engaging those inserts.

The contactor mechanism also includes a means of biasing the contactor plate toward its seated position in abutment with the conductive inserts. In the embodiment of FIG. 5, a pair of coil springs 136—136 are provided for this purpose. Each spring abuts the contactor plate on the side opposite a corresponding insert and is held in position by a receptacle 138 on bottom wall 53 which also serves as the lower wall of chamber 128.

The groove 118, which is preferably at the point of maximum slide diameter, serves as a detent for engaging a rounded end 144 on cam follower 120 so that the follower holds contactor plate 126 in its open position as illustrated in FIG. 6. As also shown in this figure, two air gaps of substantial width are provided between the contactor plate and the conductive inserts to ensure that the electrical circuit is broken when the switch is in its open position. The relatively large stroke of follower 120 is made possible by the height of chamber 128 and the large change in slide diameter between neck 112 and head 116.

The embodiments of FIGS. 5 and 6 also include a slide return spring 146 to assist in releasing the cam follower from detent groove 118 and in overcoming the frictional resistance between the push-pull wire and its housing, especially where the latter has a long run to a remote location. For purposes of retaining spring 146 in position, the slide base 112 is provided with a rearward projection 148 containing a recess 150 and the retainer barrel 90 has a bore 102. The diameter of both the recess and the bore is slightly greater than that of the coil of the spring. Barrel 90 also has a counterbore 154 of sufficient diameter to receive projection 148 of the slide.

As an alternative to the embodiment shown, the detent can be eliminated and the push-pull wire replaced by a flexible tether with a locking toggle or handle at the operator's station. The locking position of the handle would then hold the switch in its open position against the return force of the spring. Use of the slide return spring is preferred with such a flexible tether arrangement or where a relatively long push-pull wire is employed to operate the switch from a relatively remote location, such as from the operator's station near the forward end of a boat. Where shorter push-pull wires are utilized, such as in automobiles, the spring may be omitted entirely without significantly reducing the ease with which the switch may be closed. The slide may also be operated by other reciprocating mechanisms. Thus, the push-pull wire and spring can be replaced by a slide having a solid shaft extending rearwardly through the bore of the retaining barrel. In that alternative, the outer end of the shaft is attached externally to a manual knob for hand manipulation adjacent to the switch location. An annular seal washer of appropriate diameter is substituted for bushing 96 to provide a sealing element that can be clamped firmly against both the slide shaft and the retainer barrel by nut 98. Where a solid slide shaft is used, slide projection 148 and counterbore 154 may be eliminated along with wire passage 87 and set screw 88 in the slide.

As an alternative to manual operation, either the wire or the solid slide shaft can carry the plunger portion of a solenoid so that the switch can be electrically operated from a remote location. The solenoid component can be either double acting so as to drive the slide in either direction, or single acting with the slide biased toward its contactor opening position and driven closed by actuation of the solenoid coil. In the latter case, the detent groove is eliminated and the return spring is on the opposite side of the slide and has sufficient force to overcome the opposing bias of the contactor seating spring. This single acting solenoid arrangement has the advantage of automatically turning off the switch to disconnect the battery when the vehicle power is off. A time delay mechanism, either vacuum or electrical powered, can also be utilized to turn off the switch after a preselected period of time has elapsed following vehicle shutdown.

INDUSTRIAL APPLICABLITY

Although the switch of the present invention is designed specifically for use as a battery disconnect switch in the direct current circuitry of an automobile, the switch has a wide variety of applications calling for switches of watertight construction. Thus, it may be used on motorcycles, boats, airplanes, fork lifts, and off-road machinery; on stationary engine driven generators, pumps and the like; and on any other equipment requiring a battery for either starting or normal motive power. In addition, the switch can be used in alternating current circuits at either 120, 240 or 480 voltage and with either two-phase or three-phase wiring. For three-phase application or where two storage batteries supply direct current to a circuit, a third insert is molded into the switch housing and the contactor plate has three legs instead of two, the inserts and the legs being on three different axes preferably spaced 120 degrees apart. Larger numbers of contacts are also possible with one contact leg for each conductive insert. Corresponding numbers of cable apertures are also provided, one for receiving each wire to be connected to a corresponding insert. As previously described, the switch is arranged to be readily mounted on any supporting surface capable of retaining either mounting screws or bolts. It can also utilize either new or existing wiring.

In installing the switch, approximately three-quarters of an inch of insulation is stripped from each cable wire to which the switch is to be connected so as to expose the wire ends as illustrated in the drawings. Each exposed wire end is then inserted in its corresponding insert and the set screw 66 tightened to positively secure the cable wire in position. Prior to inserting the cable in the insert, the rubber boot 74 is slipped over the cable end, and after the cable is in position, the boot is slipped over the adjacent housing nipple 36 to seal the cable aperture. If a remote push-pull wire is used, both the push-pull wire and its housing are cut to proper length and nut 98 and cable bushing 96 are slipped over the free end of the housing with the free end of the wire passing through aperture 108 in the bushing end wall. The wire housing is then pushed forward until firmly seated in the bore of the bushing. The wire is passed through the slide retainer and nut 98 tightened down firmly on retainer barrel 90 to hold the bushing in sealing engagement with the wire, wire housing 104 and tapered container bore 100. Return spring 146 is slipped over the still free wire end and the wire end is then passed through passage 87 in the slide and the slide secured to the wire by tightening set screw 88. The resulting slide assembly is then inserted in the cylindrical bore 80 of switch housing 10 and the housing 10 and retainer 90 pushed together until clamping arms 92—92 snap over ridges 40—40 to lock the entire slide and actuator assembly in operative position. Reciprocal movement of the push-pull wire will now move slide 84 back and forth between the first position of FIG. 5 where the switch is closed and the second position of FIG. 6 where the switch is open.

The housing 10 may be mounted within bracket 50 either before or after attachment of the actuator mechanism 45. Prior to snapping the housing within the bracket, insulating plugs 72 are placed in the two cable set screw apertures 30—30.

I claim:

1. A switch apparatus for selectively connecting a source of electrical power to an electrical system, said apparatus comprising:

an electrically insulating housing having an elongated bore;

at least two electrically conductive bodies mounted within said housing each in spaced relation to the other;

fastening means for detachably connecting one of said conductive bodies to an electrical cable connected to said source of electrical power and the other of said conductive bodies to an electrical cable connected to said electrical system;

an electrically conductive contactor movable between a closed position in contact with each of said at least two conductive bodies and an open position out of contact with each of said at least two conductive bodies;

a cam slide carried within said elongated bore and arranged for reciprocating movement along the longitudinal axis of said bore between a first position corresponding to the closed position of said contactor and a second position corresponding to the open position of said contactor;

actuator means for causing said cam slide to move between said first and second positions in response to a signal produced externally to said electrically insulating housing; and, a cam follower cooperating with said cam slide and said contactor so that said longitudinal reciprocating movement of said cam slide causes said contactor to move between its said open and closed positions.

2. The switch apparatus of claim 1 which further includes biasing means for resiliently biasing said contactor toward said closed position and said cam follower toward said cam slide.

3. The switch apparatus of claim 2 in which said biasing means includes a coil spring positioned opposite to each of said at least two conductive bodies.

4. The switch apparatus of claim 1 in which said electrically insulating housing is made of a moldable material and said at least two conductive bodies are held within said housing by the molding of said moldable material.

5. The switch apparatus of claim 1 in which said electrically insulating housing includes a hollow chamber containing at least a portion of each of said two conductive bodies, said contactor being arranged within said chamber for reciprocating movement between its said open and closed positions.

6. The switch apparatus of claim 2 in which said cam slide includes a recess arranged to receive and frictionally engage said cam follower so as to hold said contactor in its open position.

7. The switch apparatus of claim 2 in which said cam slide is comprised of an elongated body arranged for axial sliding movement in said cam slide bore and having a transverse groove arranged to receive and frictionally engage said cam follower so as to hold said contactor in its open position.

8. The switch apparatus of claim 2 in which said electrically insulating housing includes a second bore extending transversely to the longitudinal axis of said elongated bore, and said cam follower is comprised of a shaft mounted for sliding movement in said second bore with one and of said shaft arranged to engage said cam slide.

9. The switch apparatus of claim 6 in which said actuator means includes a push-pull wire for causing said cam slide to move between its said first and second positions in response to a mechanical signal produced at a location remote from said electrically insulating housing.

10. The switch apparatus of claim 9 in which said actuator means further includes spring means for biasing said cam slide toward its said first position, the biasing force of said spring means being sufficient to overcome the frictional forces acting on said push-pull wire when said cam follower is not frictionally engaged by the recess in said cam slide.

11. The switch apparatus of claim 1 in which said actuator means includes a solid shaft connected to said cam slide and extending externally to said insulating housing.

12. The switch apparatus of claim 1 in which said electrically insulating housing includes a water tight outer wall having access ports for receiving said electrical cables and said actuator means, and in which said fastening means, said contactor, said conductive bodies, said cam slide and said cam follower are carried within said water tight housing, and said switch apparatus further includes resilient means for providing a water tight seal between said housing and said actuator means and between said housing and said cables when said actuator means and said cables are received in said access ports.

13. The switch apparatus of claim 12 in which said water tight housing is comprised of a lower section and an upper section each adapted to be ultrasonically welded to the other to form said water tight outer wall, said lower section being adapted to receive said conductive bodies, said contactor and at least a portion of said cam follower prior to said ultrasonic welding, and said upper section being adapted to receive said cam slide and at least a portion of said actuator means subsequent to said ultrasonic welding.

14. The switch apparatus of claim 12 in which said housing includes detent means for detachably holding said actuator means within one of said access ports.

15. A switch apparatus for selectively connecting a source of electrical power to an electrical system, said apparatus comprising:

an electrically insulating housing;

at least two electrically conductive bodies mounted within said housing in spaced relation to each other;

fastening means for detachably connecting one of said conductive bodies to an electrical cable connected to said source of electrical power and the other of said conductive bodies to an electrical cable connected to said electrical system;

an electrically conductive contactor movable between a closed position in contact with each of said at least two conductive bodies and an open position out of contact with each of said at least two conductive bodies;

follower means for causing said contactor to move between said closed and open positions, said follower means having a first position corresponding to the closed position of said contactor and a second position corresponding to the open position of said contactor;

actuator means for causing said follower means to move between said first and second positions in response to a signal produced externally to said electrically insulating housing, said electrically insulating housing having a water tight outer wall with access ports for receiving said actuator means, said electrical cables, and an implement for operating said fastening means so as to attach or detach said conductive bodies to said electrical cables; and, resilient means for providing a water tight seal across said implement access ports, between said housing and said actuator means, and between said housing and said electrical cables, said conductive bodies, said fastening means, said contactor, and said follower means being carried within said water tight outer wall of said electrically insulating housing.

16. The switch apparatus of claim 15 in which said resilient means includes resilient boots and said housing includes nipples around said cable access ports, said nipples having means for retaining said resilient boots in water sealing engagement with said electrical cables.

17. The switch apparatus of claim 15 in which said water tight housing is comprised of a lower section and an upper section each adapted to be ultrasonically welded to the other to form said water tight outer wall, said upper section cooperating with said lower section so as to house said conductive bodies, said fastening means, said contactor and said follower means prior to said ultrasonic welding, and said actuator means including retainer means for detachably connecting said actuator means to said housing subsequent to said ultrasonic welding.

18. The switch apparatus of claim 15 in which said actuator means frictionally engages said follower means and said actuator means includes retainer means for detachably connecting said actuator means to said housing, said retainer means holding said actuator means in frictional engagement with said follower means.

* * * * *